United States Patent [19]

Hasegawa

[11] Patent Number: 5,077,461

[45] Date of Patent: Dec. 31, 1991

[54] FAR-INFRA-RED HEATER

[75] Inventor: Nobuyuki Hasegawa, Miyagi, Japan

[73] Assignee: Tokai Konetsu Kogyo Co., Ltd., Tokyo, Japan

[21] Appl. No.: 433,739

[22] Filed: Nov. 9, 1989

[30] Foreign Application Priority Data

Jun. 9, 1987 [JP] Japan ..... 62-143509

[51] Int. Cl.[5] ..... H05B 3/10

[52] U.S. Cl. ..... 219/553; 219/464; 219/544; 428/372; 428/447

[58] Field of Search ..... 219/553, 464, 544, 411, 219/552; 428/447, 450, 446, 372; 392/407

[56] References Cited

U.S. PATENT DOCUMENTS

| | | | |
|---|---|---|---|
| 3,612,828 | 10/1971 | Siegla | 219/464 |
| 4,824,730 | 4/1989 | Fukuda et al. | 219/553 |
| 4,917,739 | 4/1990 | Adam et al. | 148/437 |
| 4,965,434 | 10/1990 | Nomura et al. | 392/407 |
| 4,999,243 | 3/1991 | Maeda | 428/372 |

OTHER PUBLICATIONS

Technical Bulletin GR-1 by the Carborundum Company, Globar; *Types A, B, and CX Resistors*, 1958.

*Technology Concise* brochure by Management Systems Institute, pp. 207-231.

*Primary Examiner*—Bruce A. Reynolds
*Assistant Examiner*—Tu Hoang
*Attorney, Agent, or Firm*—Seed and Berry

[57] ABSTRACT

A far infra-red heater comprises a resistance heating element composed of an insulating and heat resistance structural material and 5 to 60% by weight of Si or FeSi as a conductive material dispersed in the structural material. In the far infra-red radiating heater, a ceramic resistance heating element per se efficiently radiates light having a wave length falling within the far infra-red region, the heater has high thermal efficiency and sufficient mechanical strength and can be used at a temperature of up to about 600° C.

20 Claims, 1 Drawing Sheet

FAR-INFRA-RED HEATER

BACKGROUND OF THE INVENTION

1. Field of the Invention

The present invention relates to a far infra-red heater. More specifically, the present invention pertains to a far infra-red heater which comprises a ceramic resistance heating element obtained by mixing and dispersing an insulating heat resistant component and a conductive component, wherein the resistance heating element per se directly radiates rays having a wave length falling within the far infra-red region efficiently.

2. Description of the Prior Art

Up to now, there have been knwon various far infra-red heaters such as (1) an infra-red heater comprising a quartz tube and a tungsten filament enclosed therein or a quartz tube heater comprising a quartz pipe and a nichrome wire enclosed therein; (2) a heater obtained by coating the metal surface of a sheathed wire heater, which comprises a metal tube and a nichrome wire enclosed therein through an insulater such as magnesium oxide, with a ceramic far infra-red radiating material such as those comprising alumina, zirconia and titania; and (3) a heater comprising a ceramic tube made of the foregoing far infra-red radiating material and a nichrome wire enclosed therein.

In the aforementioned far infra-red heaters, a commercial voltage is in general applied to both ends thereof to generate Joule heat whereby the temperature of the surface of the heater is raised to a predetermined level ranging from 200° to 600° C. If the temperature of the heater is raised, the radiant quantities of infra-red rays correspondingly increase, thus a substance to be heated is irradiated with the infra-red rays radiated by the heater and the surface of the substance absorbs the infra-red rays whereby the substances per se are heated.

For this reason, the heating effect of the far infra-red rays greatly depends on the radiation properties of a far infra-red heater and the infra-red absorption characteristics of a substance to be heated.

In other words, a far infra-red heater should radiate infra-red rays compatible with the absorption characteristics of a substance to be heated. Under such circumstances, various kinds of heaters have practically been used depending on a variety of applications. Examples of typical applications of such heaters are baking and drying of paints, inks or the like, drying of lumbers, grilling of foods and heating such as floor heating and a sauna.

The foregoing conventional far infra-red heaters suffer from the following disadvantages:

First of all, in the aforementioned infra-red lamp or the quartz tube heater (1), light generated by an electrically heated wire is radiated through quartz wall. As a result, the wave length of the principal radiant rays falls within the range of near infra-red rays in the order of 1.5μ and, therefore, such a heater or a lamp does not radiate sufficient quantity of light having a wave length falling within the far infra-red range. Moreover, these heaters have low mechanical strength.

Although the aforesaid heaters (2) obtained by coating a sheathed wire heater with a ceramic far infra-red radiating material efficiently radiate far infra-red rays having a wave length of 3 to 50μ, they suffer from an inevitable problem that the ceramic radiating material is peeled off from the surface of the metal tube due to the difference between the thermal expansion coefficients of the metal tube and the ceramic radiating material applied onto the surface of the former.

The foregoing heaters (3) comprising a ceramic tube and a nichrome wire enclosed therein make it possible to solve the problem of peeling off of the coated material associated with the foregoing sheathed wire heaters (2), they can be made lighter since it is not necessary to use any insulating materials and they make it possible to improve their thermal efficiency. However, they still suffer from drawbacks originated from the fact that the heating is performed by an indirect heating method in which a radiant is indirectly heated by heating a nichrome wire. More specifically, a problem that the electrically heated wire such as a nichrome wire is locally heated abnormally to thus result in burning out of the wire due to the increase in the resistance of the wire because of its oxidation and corrosion has not yet been solved. Moreover, they further suffer from the problems concerning, for instance, thermal energy loss due to indirect heating; uneven distribution of temperature and retardation of response time in the temperature control.

SUMMARY OF THE INVENTION

The present invention intends to solve these problems and a principal object of the present invention is to provide a far infra-red radiating heater in which a ceramic resistance heating element per se efficiently radiates light having a wave length falling within the far infra-red region, which has high thermal efficiency and sufficient mechanical strength and which can be used at a temperature of up to about 600° C.

The foregoing object of the present invention can effectively be attained by providing a far infra-red heater which comprises a resistance heating element composed of an insulating and heat resistant structural material and 5 to 60% by weight of Si or FeSi as a conductive material dispersed in the structural material.

BRIEF DESCRIPTION OF THE DRAWINGS

The far infra-red heater of the present invention will be described in more detail with reference to the accompanying drawings, wherein.

DETAILED EXPLANATION OF THE INVENTION

Figure 1:
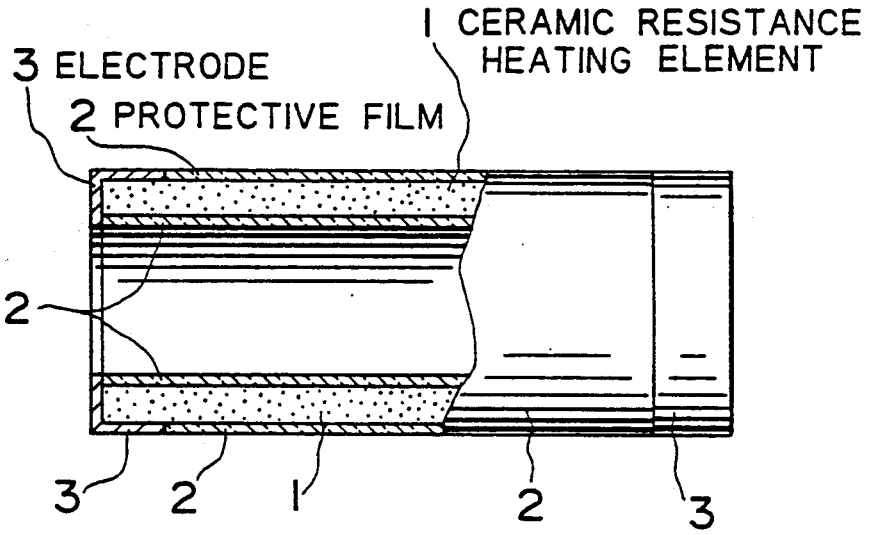
FIG. 1 is a sectional view of the principal parts of an embodiment of the far infra-red heater according to the present invention.

Examples of the most preferred insulating heat resistant structural materials as used herein include ceramic materials principally comprising aluminosilicates. This is because these ceramic materials have high rate of radiation and can be sintered at a temperature less than the melting point of Si (1410° C.). As other heat resistant structural materials which may be used in the present invention, there may be mentioned, for instance, those listed below (in the following composition, "%" means "% by weight"):

(i) $ZrO_2$. $TiO_2$ type: $ZrO_2$. $SiO_2$ 40~60%, $TiO_2$ 5~25% $ZrO_2$. $SiO_2$ 30~50%, $TiO_2$ 25~60%

(ii) $Al_2O_3$. $TiO_2$ type: $Al_2O_3$ 40~70%, $TiO_2+SiO_2$ 25~45%

(iii) $TiO_2$ type: $TiO_2$ not less than 90%; $Cr_2O_3$ not more than 10%

(iv) $Fe_2O_3$. $SiO_2$ type:
$Fe_2O_3$ 25~45%,
$SiO_2$ 25~45% (slug of copper minerals)
$SiO_2$ 30~80%,
$Al_2O_3+Fe_2O_3$ 5.5~60%

(v) Those which comprise a mixture of at least one member selected from the group consisting of oxides, carbides and nitrides of elements of Group II and III of the Periodic Table with at least one member selected from the group consisting of oxides, carbides and nitrides of elements of Group IV and V of the Periodic Table, for instance, $MgO$-$Fe_2O_3$-$SiO_2$-$TiO_2$-$CaO$-$MnO_2$-$ZrO_2$ type ones.

(vi) SiC type ones.

The structural materials principally comprising aluminosilicate generally contain 0.5 to 30% of a metal oxide (comprising at least one member selected from the group consisting of $Fe_2O_3$, $Cr_2O_3$, $Mn_2O_3$, $ZrO_2$, $TiO_2$, $MnO_2$, $Li_2O$, CaO, MgO, NiO, CoO and $Cu_2O$) in addition to $Al_2O_3$ and $SiO_2$. Specific examples of such structural materials are as follows:

| | $SiO_2$ (%) | $Al_2O_3$ (%) | $K_2O$ (%) |
|---|---|---|---|
| KIBUSHI clay | 49 | 33 | |
| GAIROME clay | 47 | 35 | |
| Kaolin | 45 | 40 | |
| AMAKUSA pottery stone | 47 | 36 | |
| Potash feld spar | 65 | 20 | 11 |
| Pyroferrite | 66 | 27 | |
| Bentonite | 59 | 14 | |

In addition to the foregoing examples, petalite ($Li_2O$, $Na_2O$, $Al_2O_3$, $8SiO_2$) and talc ($4SiO_2$, 3MgO, $H_2O$) can also be used in the invention.

In the far infra-red heaters of this invention, the foregoing structural material such as the aforesaid clayey materials may be used alone or in combination. More preferably, these structural materials in which glass components are incorporated are used.

The glass components are not restricted to specific ones so far as they are heat resistant at a temperature at which the resultant heater is employed, but silicate glasses having a low thermal expansion coefficient such as $SiO_2$ type glasses, $SiO_2$-$Al_2O_3$ type glasses, $SiO_2$-$B_2O_3$ type glasses, $SiO_2$-$Li_2O$ type glasses and $SiO_2$-ZnO type glasses are particularly preferred in the present invention to improve the thermal shock resistance of the resulting resistance heating element. Moreover, the glass component may be crystalline glasses which are converted into a ceramic after calcination. Specific examples thereof will be listed below:

EXAMPLES OF NON-CRYSTALINE GLASSES

1) $SiO_2$ type glasses ($SiO_2$ 100% [quartz powder], $SiO_2$ 96%);
2) $B_2O_3$-$SiO_2$ type glasses ($SiO_2$ 80%, $B_2O_3$ 10%, $Al_2O_3$ 4%)
3) $Al_2O_3$-$SiO_2$ type glasses ($SiO_2$ 55%, $Al_2O_3$ 23%, $B_2O_3$ 7%)

EXAMPLES OF THE CRYSTALLINE GLASSES

1) $LiO_2$-$SiO_2$ type glasses ($SiO_2$ 65~81%; $Li_2O$ 7~15%; $Al_2O_3$ 4~20%)
2) ZnO-$SiO_2$ type glasses ($SiO_2$ 44~51%; ZnO 19~26%; $Al_2O_3$ 17~23%)
3) MgO-$Al_2O_3$-$SiO_2$ type glasses ($SiO_2$ 43~64%; MgO 13~25%; $Al_2O_3$ 14~31%)
4) $Li_2O$-$Al_2O_3$-$SiO_2$ type glasses ($SiO_2$ 59~70%; $Li_2O$ 3~4%; $Al_2O_3$ 12~15%)

The amount of the glass component to be incorporated into the structural materials preferably ranges from 10 to 50% by weight on the basis of the total weight of the structural material.

Specific formulations of the structural materials of the present invention are as follows:

1) KIBUSHI clay 70%; borosilicate glass 30%
2) GAIROME clay 70%; feldspar 30%
3) alumina 30%; KIBUSHI clay 30%; aluminosilicate glass 40%
4) kaolin 60%; KIBUSHI clay 15%; talc 15%; magnesite 10%
5) petalite 75%; lithium carbonate 15%; alumina 10%

The resistance heating element of the present invention can be prepared by adding a conductive material, i.e., Si or FeSi, water and optionally a proper binder to a structural material, for instance, a clayey component or a combination of a clayey component and a glass component, kneading the mixture, forming the mixture into a desired shape and then calcining the same at a temperature ranging from 1,000° to 1,400° C.

The conductive material, i.e., Si or FeSi is added to the structural material for the resistance heating element in an amount ranging from 5 to 60% by weight on the basis of the total weight of the resistance heating element. The resistance of the resistance heating element can be freely adjusted within the range of from $10^{-2}$ to $10^{1}$ Ω·cm by changing the amount of Si or FeSi to be incorporated into the structural material. In addition, the resistance heating element of the present invention has a positive resistance thermal coefficient. If the amount of Si or FeSi is less than 5% by weight, the resistance of the resultant resistance heating element is too large to ensure the functions of the resultant product as a resistance heating element, while if it is more than 60% by weight, the resistance of the resultant resistance heating element becomes too low and it also has low mechanical strength.

When the structural material contains a glass component and the structural material is calcined at a temperature ranging from 1,000 ° to 1,400° C., molten glass component flows out on the surface of the structural material to thus form an insulating glass protective film or layer on the surface of the resistance heating element. On the other hand, if the structural material does not contain a glass component and the material is calcined at a temperature ranging from 1,000° to 1,400° C. in the air, silicon present on the surface thereof is oxidized to thus form an insulating $SiO_2$ protective film or layer on the surface of the resulting resistance heating element. Alternatively, it is also possible to calcine the structural material in an inert gas atmosphere such as argon gas atmosphere and then it is again calcined in an oxidizing gas atmosphere such as air to thus form a protective film or layer on the surface of the resultant resistance heating element.

The raw material for the resistance heating element can be formed into a desired shape by any known methods such as extrusion molding, pressure molding in a mold and doctor blade molding. The resistance heating element of the present invention may be formed into any shapes such as tubular, rod-like and plate-like shapes. A conductive film is formed on the both ends of the resistance heating element by a metal spray technique, welding technique or baking of a conductive paste to obtain a far infra-red heater.

The far infra-red heater of the present invention thus manufactured can efficiently radiates far infra-red rays having a wave length ranging from 3 to 50μ and can stably be used at a temperature of up to 600° C.

The frequency of the far infra-red rays coincides with the intrinsic molecular frequency of polymeric compounds and, therefore, heaters should radiate a large quantity of energy falling within the far infra-red region. The heaters of the present invention can radiate a large quantity of energy within the range of far infra-red rays and are applicable in most of applications in which far infra-red rays are employed for heating.

Moreover, the electrical conditions and the temperature conditions of the resulting heater may be freely selected by changing the amount of Si or FeSi to be incorporated as has been described above. In general, the heaters are frequently used so that the surface temperature of 400° C. is established when the commercial voltage is applied thereto.

As has been described above, the purpose of the present invention is to improve the temperature distribution and the responsibility (response time) of the heater. The former is greatly improved since the heaters of this invention have a uniform composition, while regarding the latter, there can be provided heaters exhibiting fast responsibility compared with the conventional heaters since the material for the heater is identical with the far infra-red radiating material.

As has been described above, the heaters of the present invention simultaneously have a variety of properties required for far infra-red heating and are hence practically applicable in most of applications. Therefore, the heaters of the present invention are epoch-making ones.

The present invention will hereunder be described in more detail with reference to the following non-limitative working Examples and the effect practically attained by the invention will also be discussed in detail.

EXAMPLE

FIG. 1 is a sectional view of the principal parts of an embodiment of the far infra-red heater according to the present invention.

A resistance heating element 1 coated with an insulating glass protective film 2 having an outer diameter of 15 mm, an inner diameter of 10 mm and a length of 500 mm was manufactured by hydrating and mixing a mixture of 65% by weight of a starting material composed of 70% by weight of KIBUSHI clay and 30% by weight of borosilicate glass having a thermal expansion coefficient of not more than $50\times10^{-7}$/° C. and a softening point of not less than 700° C. and 35% by weight of silicon powder; forming the mixture into a tube-like product; drying the shaped product; and then calcining the shaped product at a temperature ranging from 1,300° to 1,400° C. in the air. The glass protective film 2 on the both ends of the resultant heating element 1 was removed over a width of 15 mm and then the ends thereof was subjected to metal spray of Al to form electrodes 3.

Figure 2:
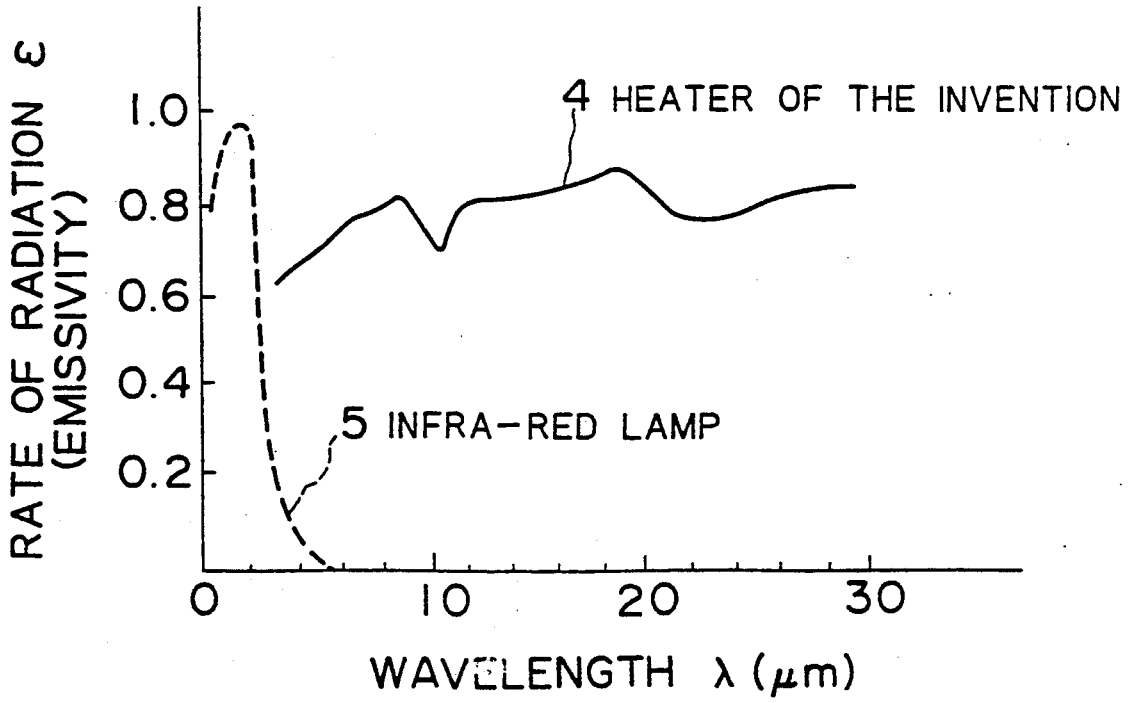
FIG. 2 is a graph showing the relation between the wave length of the heater of this invention and that of a conventional infra-red lamp and their spectral rate of radiation (emissivity).

The spectral rate of radiation at each wave length at the surface temperature of 500° C. was determined on the far infra-red heater of the present invention thus manufactured and the results obtained were plotted on FIG. 2. As seen from the data plotted on FIG. 2, it is confirmed that the heater of the invention effectively radiates far infra-red rays having a wave length ranging from 3 to 30μ as compared with the conventional infra-red lamp (see the broken line on FIG. 2). In addition, the heater of the invention has the following excellent physical properties: porosity=0%; thermal expansion coefficient=$40\times10^{-7}$/° C. (at a temperature between 0° to 600° C.); bending strength as determined according to JIS-R-1601=700 to 1,000 kg/cm$^2$. These physical properties indicate that the heater of the invention is composed of a compact material having a low thermal expansion coefficient and that it has high bending strength. Therefore, it is clear that the heater has sufficient resistance to thermal shock and practically acceptable mechanical strength.

When a voltage of 100 V was applied to the foregoing far infra-red heater of the invention, the power thereof was 400 W and the surface temperature was 400° C. Regarding the responsibility, when the heater was used as a heat source for a hair dryer, the temperature of the heater reached 350° C. after 60 seconds, while the temperature of a conventional heater comprising a ceramic tube and a nichrome wire enclosed therein was raised to only 150° C. after 60 seconds. Moreover, the heater of the present invention exhibits very good temperature distribution. More specifically, that of the conventional heater was ±12° C., while that of the heater of the invention was ±6° C. When the hair dryer was used for having the hair permed, such an operation could be performed for a very short period of time and the finished condition of the hair was uniform and excellent.

As has been practically demonstrated in the foregoing Example, the far infra-red heater of the present invention shows the following effects since the ceramic resistance heating element per se serves as the far infra-red radiant:

(1) It can be formed into any shape and the far infra-red radiant per se can directly generate heat. Therefore, it has a low heat capacity, quick heating properties and a high thermal efficiency. Moreover, the temperature control of the heating element can be rapidly performed. Thus, it shows a high energy-saving effect.

(2) It has a high mechanical strength and hence the use of any reinforcing materials is not needed. Moreover, the resistance of the heater may be freely selected within a certain range by adjusting the amount of the conductive material such as Si or FeSi to be incorporated thereinto. Therefore, there is very large room for the design of the far infra-red heater.

(3) It is not necessary to use a nichrome wire in the ceramic heating element of the invention. Therefore, there is no possibility of burning out and good temperature distribution can be attained.

(4) The method for manufacturing the heaters and the structure thereof are quite simple. Thus, the heater of this invention can be supplied at a low price.

What is claimed is:

1. A far infra-red heater comprising a resistance heating element composed of an insulating and heat resistant structural material and 5 to 60% by weight of Si or FeSi as a conductive material dispersed in the structural material.

2. The far infra-red heater of claim 1 wherein it further comprises an insulating glass protective layer on the resistance heating element.

3. The far infra-red heater of claim 1 wherein the insulating and heat resistant structural material is a material principally comprising an aluminosilicate.

4. The far infra-red heater of claim 1 wherein the insulating and heat resistant structural material is selected from those capable of being sintered at a temperature less than 1410° C.

5. The far infra-red heater of claim 4 wherein the insulating and heat resistant structural material is selected from the group consisting of (i) $ZrO_2 . TiO_2$ type glasses; (ii) $Al_2O_3 . TiO_2$ type glasses; (iii) $TiO_2$ type glasses containing not less than 90% of $TiO_2$ and not more than 10% of $Cr_2O_3$; (iv) $Fe_2O_3 . SiO_2$ type glasses; (v) a mixture of at least one member selected from the group consisting of oxides, carbides and nitrides of elements of Group II and III of the Periodic Table with at least one member selected from the group consisting of oxides, carbides and nitrides of elements of Group IV and V of the Periodic Table; and (vi) SiC type ones.

6. The far infra-red heater of claim 1 wherein the insulating and heat resistant structural materials principally comprising aluminosilicate contains 0.5 to 30% of at least one metal oxide selected from the group consisting of $Fe_2O_3$, $Cr_2O_3$, $Mn_2O_3$, $ZrO_2$, $TiO_2$, $MnO_2$, $Li_2O$, Cao, MgO, NiO, CoO and $Cu_2O$ in addition to $Al_2O_3$ and $SiO_2$.

7. The far infra-red heater of claim 1 wherein the insulating and heat resistant structural material is a member selected from the group consisting of KIBUSHI clay, GAIROME clay, kaolin, AMAKUSA pottery stone, potash feld spar, pyroferrite, bentonite, petalite and talc.

8. The far infra-red heater of claim 1 wherein the insulating and heat resistant structural material further comprises glass components.

9. The far infra-red heater of claim 8 wherein the glass components is selected from the group consisting of $SiO_2$ type glasses, $SiO_2$-$Al_2O_3$ type glasses, $SiO_2$-$B_2O_3$ type glasses, $SiO_2$-$Li_2O$ type glasses, $SiO_2$-ZnO type glasses and crystalline glasses which are converted into a ceramic after calcination.

10. The far infra-red heater of claim 8 wherein the glass component is selected from the group consisting of 1) $SiO_2$ type glasses; 2) $SiO_2$-$B_2O_3$ type glasses; 3) $SiO_2$-$Al_2O_3$ type glasses.

11. The far infra-red heater of claim 8 wherein the crystalline glass is selected from the group consisting of 1) $LiO_2$-$SiO_2$ type glasses containing $SiO_2$ 65~81%; $Li_2O$ 7~15%; and $Al_2O_3$ 4~20%; 2) ZnO-$SiO_2$ type glasses containing $SiO_2$ 44~51%; ZnO 19~26%; and $Al_2O_3$ 17~23%; 3) MgO-$Al_2O_3$-$SiO_2$ type glasses containing $SiO_2$ 43~64%; MgO 13~25%; and $Al_2O_3$ 14~31%; and 4) $Li_2O$-$Al_2O_3$-$SiO_2$ type glasses containing $SiO_2$ 59~70%; $Li_2O$ 3~4%; and $Al_2O_3$ 12~15%.

12. The far infra-red heater of claim 8 wherein the amount of the glass component to be incorporated into the structural materials ranges from 10 to 50% by weight on the basis of the total weight of the structural material.

13. The far infra-red heater of claim 8 wherein the structural materials is selected from the group consisting of:

1) KIBUSHI clay 70% and borosilicate glass 30%;
2) GAIROME clay 70% and feld spar 30%;
3) alumina 30%, KIBUSHI clay 30% and aluminosilicate glass 40%;
4) kaolin 60%, KIBUSHI clay 15%, talc 15% and magnesite 10%; and
5) petalite 75%, lithium carbonate 15% and alumina 10%.

14. The far infra-red heater of claim 1 wherein the resistance of the resistance heating element ranges from $10^{-2}$ to $10^{1}$ Ω·cm.

15. The far infra-red heater of claim 1 wherein it radiates far infra-red rays having a wave length ranging from 3 to 50 μ and is used at a temperature of up to 600° C.

16. A method for generating far infra-red rays, which comprises applying electric voltage to a heater comprising a resistance heating element composed of an insulating and heat resistant structural material and 5 to 60% by weight of Si or FeSi as a conductive material dispersed in the structural material to thereby heat the surface of the heat temperature of 200° C. to 600° C.

17. The method claim 16 wherein the heater further comprises an insulating glass protective layer on the resistance heating element.

18. The method of claim 16 wherein the insulating and heat resistant structural material is selected from the group consisting of (i) $ZrO_2 . TiO_2$ type glasses; (ii) $Al_2O_3 . TiO_2$ type glasses; (iii) $TiO_2$ type glasses containing not less than 90% of $TiO_2$ and not more than 10% of $Cr_2O_3$; (iv) $Fe_2O_3 . SiO_2$ type glasses; (v) a mixture of at least one member selected from the group consisting of oxides, carbides and nitrides of elements of Group II and III of the Periodic Table with at least one member selected from the group consisting of oxides, carbides and nitrides of elements of Group IV and V of the Periodic Table; and (vi) SiC type ones.

19. An apparatus for generating far infra-red rays, which comprises a resistance heating element composed of an insulating and heat resistant structural material and 5 to 60% by weight of Si or FeSi as a conductive material dispersed in the structural material and electrodes provided on the both ends of the element.

20. The apparatus of claim 19, wherein the element is in the form of a bar.

* * * * *

UNITED STATES PATENT AND TRADEMARK OFFICE

CERTIFICATE OF CORRECTION

PATENT NO. : 5,077,461

DATED : December 31, 1991

INVENTOR(S) : Nobuyuki Hasegawa

It is certified that error appears in the above-identified patent and that said Letters Patent is hereby corrected as shown below:

In column 7, claim 6, line 25, please delete "Cao" and substitute therefor -- CaO --.

Signed and Sealed this

Sixth Day of April, 1993

*Attest:*

STEPHEN G. KUNIN

*Attesting Officer*

*Acting Commissioner of Patents and Trademarks*